United States Patent [19]

Mayer

[11] 4,332,149

[45] Jun. 1, 1982

[54] NEEDLE BAR ADJUSTMENT MECHANISM FOR WARP KNITTING MACHINES

[75] Inventor: Ingo Mayer, Obertshausen, Fed. Rep. of Germany

[73] Assignee: Karl Mayer Textilmaschinenfabrik GmbH, Obertshausen, Fed. Rep. of Germany

[21] Appl. No.: 165,018

[22] Filed: Jul. 1, 1980

[30] Foreign Application Priority Data

Jul. 6, 1979 [DE] Fed. Rep. of Germany ..... 2927335

[51] Int. Cl.[3] ..... D04B 23/02

[52] U.S. Cl. ..... 66/87

[58] Field of Search ..... 66/203, 87, 88, 84

[56] References Cited

U.S. PATENT DOCUMENTS 3,221,520 12/1965 Bassist ..... 66/87

4,267,709 5/1981 Hittel ..... 66/87

*Primary Examiner*—Ronald Feldbaum

*Attorney, Agent, or Firm*—Omri M. Behr

[57] ABSTRACT

A needle bar adjustment bar mechanism that may be used to alter the separation between the knockover points on a warp knitting machine includes a pair of support members. Each of the support members has the guiding means for one of the needle bars and the associated trick plate affixed thereon. An adjustment control provides for the simultaneously moving of the support members to increase the separation between the trick plates while maintaining essentially constant the distance between the needles on one of the pair of needle bars with respect to the needles on the other needle bar at their uppermost dead point of travel.

6 Claims, 1 Drawing Figure

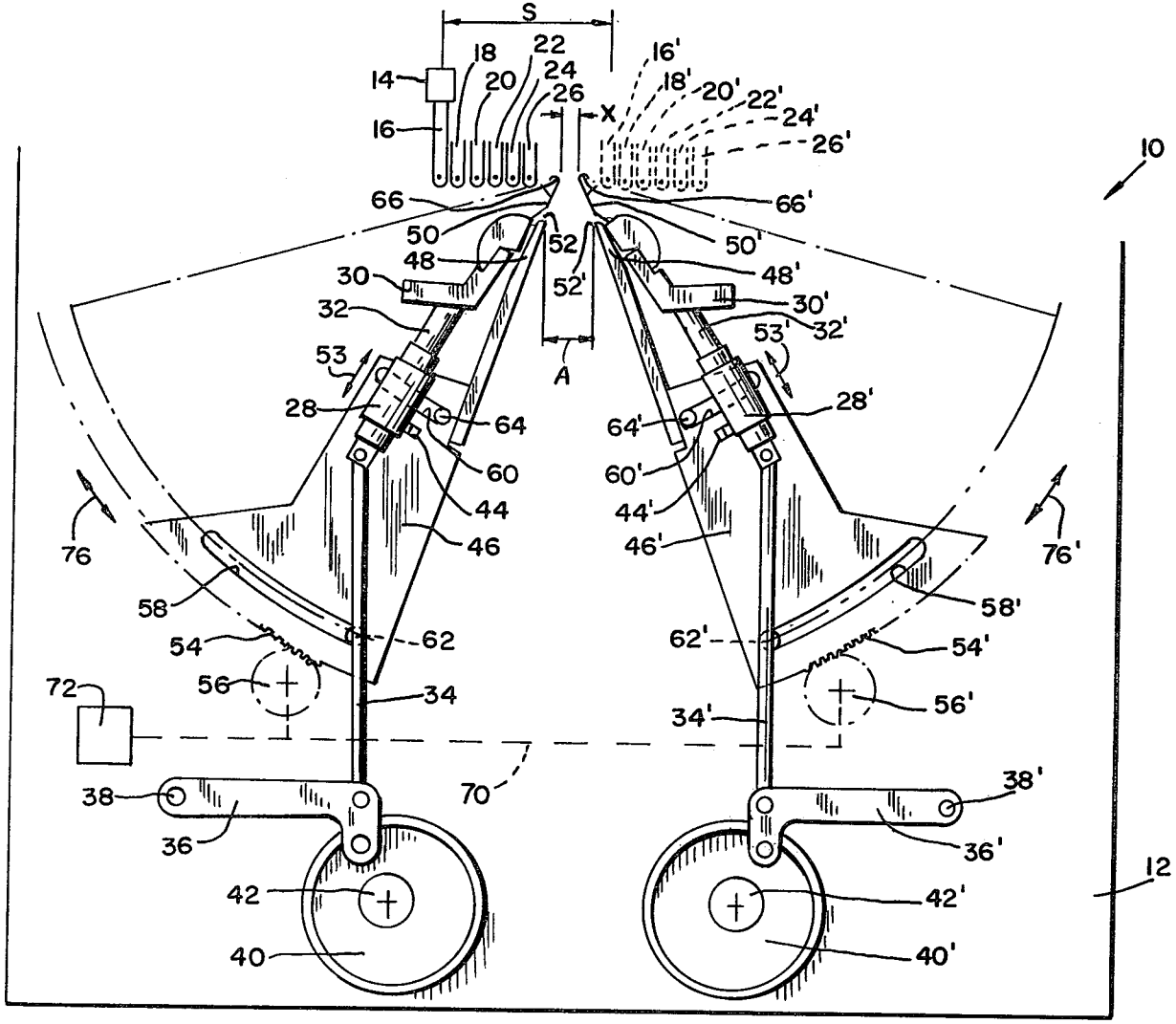
10
12
14
16
18
20
22
24
26
S
X
A
28
30
32
34
36
38
40
42
44
46
48
50
52
53
54
56
58
60
62
64
66
70
72
76

NEEDLE BAR ADJUSTMENT MECHANISM FOR WARP KNITTING MACHINES

BACKGROUND OF THE INVENTION

1. Field of the Invention

The present invention relates to a double bedded warp knitting machine, and in particular to a double bedded warp knitting machine that utilizes an adjustment mechanism to separate the needle bars and associated trick plates to provide pile ware with different pile lengths.

2. Discussion of the Relevant Art

U.S. Pat. No. 3,221,520 issued to R. G. Bassist on Dec. 7, 1965 discloses a double-needlebed warp knitting machine that makes provision for adjusting the pile height of the ware manufactured by individually moving the knockover points and needle bar by means of adjustment screws. As disclosed, this was accomplished by utilizing two or more guide bars which cooperate with a needle and trick plate mounted and driven in one housing and a separate guidebar cooperating with a needle bar and trick plate mounted in another housing. Both housing are capable of being moved apart so that the knockover points of both needle bars may be spaced apart as desired. A third independent guidebar is used to swing from one needle bar to the other needle bar thereby providing the pile threads. This causes the guide bar that swings from one needle bar to the other to be adjusted each time the distance between the two needle bars are varied. This resetting requires a substantial amount of time and sufficient skill to have each piece aligned in the proper manner.

The present invention overcomes this shortcoming by providing an adjustment mechanism that simultaneously moves the support members that carry the needle bar and trick plate close together or further apart while maintaining a constant distance between the needles on one needle bar with respect to the needles on the second needle bar at their uppermost dead point of travel so that a guide bar swinging around the pair of needle bars always swings the same distance regardless of the setting of pile height.

Therefore, it is an object of the present invention to provide a needle bar adjustment mechanism to alter the separation between knockover points on a warp knitting machine that may be easily adjusted by a person having minimum skills.

It is another object of the present invention to provide a needle bar adjustment mechanism to alter the separation between knockover points without deteriorating the speed of the machine.

It is a further object of the present invention to provide a needle bar adjustment mechanism which simultaneously moves both needle bars and their associated trick plates with a single control knob.

A needle bar adjustment mechanism to alter the separation between knockover points on a warp knitting machine, according to the principles of the present invention, having a frame, a pair of needle bars with a plurality of needles affixed thereon, a trick plate cooperating with each of the needle bars, a plurality of guide bars having a plurality of guides affixed thereon and a driving power source operatively coupled to the needle bars and the guide bars comprises in combination, a pair of support members having a guiding device for one of the needle bars and its associated trick plate affixed thereon. An adjustment control is provided for simultaneously moving the support members apart to increase the separation between the trick plates while maintaining essentially constant the distance between the needles on one of the pair of needle bars with respect to the needles on the other needle bar at their uppermost dead point of travel.

The foregoing and other objects and advantages will appear from the description to follow. In the description, reference is made to the accompanying drawing which forms a part hereof, and in which is shown by way of illustration a specific embodiment in which the invention may be practiced. This embodiment will be described in sufficient detail to enable those skilled in the art to practice the invention, and that it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the sole accompanying drawing which is a partial schematic representation of a double-bedded warp knitting machine, according to the principles of the present invention.

DESCRIPTION OF THE PREFERRED EMBODIMENT

Referring now to the sole FIGURE which discloses schematically a needle bar adjustment mechanism 10 for a warp knitting machine, not shown, having a main frame 12 and a plurality of guide bars 14, only one of which being illustrated for clarity. Each of the guide bars has a plurality of guides 16 affixed thereon, in a conventional manner. Additional guides 18, 20, 22, 24, and 26 are shown at the upper lefthand side of the drawing in their first position. The guides are shown in their most rearward position. The guides 16', 18', 20', 22', 24' and 26' are shown in dotted lines to indicate the position of the guides in their most forward position. The total distance travelled by the guide is indicated by S and although shown in the drawing as having moved in a relatively straight line, it is well known by those knowledgeable in the art, that the actual movement is in an arcuate path.

A needle bar 30 has one end of a piston rod 32 affixed thereon. The piston 32 is slidably retained by a housing 28 and is pivotably connected by means of a pushrod 34 to a lever 36. The lever 36 is movable about an axis 38 and is coupled to eccentric gear 40 affixed to a drive shaft 42, in a conventional manner. The housing 28 is affixed by means of a bracket 44 to a generally pie-shaped support member 46, in a conventional manner, which also has affixed thereto trick plate 48, that cooperates with the needle bar 30 and a plurality of needles 50 disposed thereon.

The needle bar 30 is moved in the direction of arrow 53 by the rotation of drive shaft 42 causing eccentric cam 40 to move lever 36 upwardly and downwardly thereby moving piston 32, carrying the needle bar 30 along with it. As shown, the needles 50 are in their uppermost dead point of travel and as drive shaft 42 rotates they are lowered therefrom until they reach the edge or knockover point 52 of trick plate 48.

The pie-shaped support member 46 is provided with a curved toothed segment 54 which is adapted to cooperate with a toothed wheel or gear 56 in a conventional manner. Preferably, a pair of spaced apart arcuate and concentric slots 58 and 60 are provided in the support member 46. A pair of guide pins 62 and 64 are affixed to the frame 12 of the warp knitting machine, in a conventional manner, and are adapted to be received into slots 58 and 60 in order to control the path of movement of the support member 46 so that support member 46 will travel in an arcuate path having its center point occur at the uppermost dead point of travel 66 of needles 50 as shown by the dotted line and indicated by r.

Although the preferred embodiment discloses the use of a pair of arcuate slots 58 and 60 and a pair of associated guide pins 62 and 64, it is possible to operate the adjusting mechanism utilizing a single slot. However, a pair of guide pins 62, such as that shown would have to be used within the slot or alternatively, an elongated arcuate guiding member would be required in order to provide the necessary stability for the support member 46.

The warp knitting machine includes a second pie-shaped support member 46' which has affixed thereon, by means of a bracket 44', a guiding means or housing 28' which is coupled to a second needle bar 30', via a piston 32' and a second trick plate 48' associated therewith. Since the support member 46' and all the corresponding drive mechanisms for the needle bar and trick plate are a mirror image of the components described hereinbefore, they have been given like numerals suffixed by a prime. Both halves of the adjustment mechanism function in the same manner and have been given primed numeral designations for clarity.

The toothed needles or gears 56 and 56' are coupled together, in a conventional manner, as indicated by the dotted line 70 and are coupled to an adjusting mechanism 72 which may include a manual control knob or it may be motor driven. By rotation of the adjusting mechanism toothed wheels 56 and 56' are turned simultaneously and in opposite directions so that the pie-shaped support members 46 and 46' are caused to move in the direction of arrows 76 and 76', respectively, following an arcuate path as defined by the radius r and r'.

The needles 50 and 50' are spaced apart by a distance indicated by X in the FIGURE and remains constant so that regardless of the setting of the adjusting mechanism 72 the guide bar 14 will always be required to swing no more than the distance indicated by the letter S. The height of the pile is indicated by the distance shown as A and is the point between knockover points 52 and 52' of the two trick plates 48 and 48' and is the position at which the needles are located just before they dip into or contact the trick plates. This separation (A) may readily be adjusted by the arcuate movement of the support members 46 and 46' by the adjusting mechanism 72. As is readily discernable from the drawing, movement of the support members 46 and 46' will not change the distance X although the height of the pile (determined by the distance A) can be varied considerably. Once a new setting for the pile height has been determined it may be left in that position until it is desired to change the height of pile on the ware being manufactured. The setting for the guide bar swing need not be changed although the height of the pile has been altered since as indicated before, the distance between the needles on needle bar 30 and the needles on needle bar 30' at their uppermost dead point of travel remain fixed.

Hereinbefore has been disclosed a simple needle bar adjustment mechanism capable of varying the height of pile on ware being manufactured without altering the distance between the needles on one needle bar with respect to the needles on the other needle bar at their uppermost dead point of travel without requiring highly technical or skilled personnel. It will be understood that various canges in the details, materials, arrangement of parts and operating conditions which have been herein described and illustrated in order to explain the nature of the invention may be made by those skilled in the art within the principles and scope of the instant invention.

Having thus set forth the nature of the invention, what is claimed is:

1. A needle bar adjustment mechanism to alter the separation between knockover points on a warp knitting machine having a frame, a pair of needle bars with a plurality of needles affixed thereon, a trick plate cooperating with each said needle bar, a plurality of guide bars having a plurality of guides affixed thereon and a driving power source operatively coupled to said needle bars and said guide bars, comprising, in combination:

(a) a pair of support members, each said support member having the guiding means for one of said needle bars and said associate trick plate affixed thereon; and (b) means for simultaneously moving said support members apart to increase the separation between said trick plates, while maintaining essentially constant the distance between said needles on one of said pair of needle bars with respect to the needles on the other needle bar at their uppermost dead-point of travel.

2. A needle bar adjustment mechanism according to claim 1 wherein each of said support members is movable in an arc having its center point substantially at said uppermost dead point of travel of said needles.

3. A needle bar adjustment mechanism according to claim 2 wherein said support members are operatively coupled together for simultaneous movement in opposite directions.

4. A needle bar adjustment mechanism according to claim 1 wherein said support members are pie-shaped having a curved toothed segment with an axis of rotation about said uppermost dead point of travel of said needles, a pair of adjusting gears, one of said gears being adapted to cooperate with each said curved tooth segments for their movement, and adjustment means operatively coupled to said adjusting gears for rotation of said adjusting gears in opposite directions.

5. A needle bar adjustment mechanism according to claim 1 wherein each said support member is provided with at least one arcuate-shaped slot having its center point at said uppermost dead point of travel of said needles and at least one guide pin affixed to said warp knitting machine frame, said guide pin cooperating with said slot to control the path of movement of said support member.

6. A needle bar adjustment mechanism according to claim 1 wherein each said support member is provided with two spaced apart concentric slots having their center point at said uppermost dead point of travel of said needles and four guide pins affixed to said warp knitting machine frame, one of said guide pin cooperating with each of said slots to control the path of movement of each of said support members.

* * * * *